US007221272B2

(12) United States Patent
Hosselet

(10) Patent No.: US 7,221,272 B2
(45) Date of Patent: May 22, 2007

(54) ELECTRONIC LOCK MODULE

(76) Inventor: Hubert Hosselet, 500, Carignan, Boisbriand, Quebec (CA) J7G 2M9

( * ) Notice: Subject to any disclaimer, the term of this patent is extended or adjusted under 35 U.S.C. 154(b) by 236 days.

(21) Appl. No.: 10/856,245

(22) Filed: May 28, 2004

(65) Prior Publication Data

US 2004/0237609 A1 Dec. 2, 2004

Related U.S. Application Data

(60) Provisional application No. 60/474,311, filed on May 30, 2003.

(51) Int. Cl.
*E05B 45/06* (2006.01)

(52) U.S. Cl. ..... 340/542; 340/543; 340/5.22; 340/5.54; 340/5.55; 70/277

(58) Field of Classification Search ..... 340/543, 340/545.2, 545.3, 5.55, 5.6, 5.54, 5.22, 542; 70/277, 278.3, 283, 283.1; 235/382
See application file for complete search history.

(56) References Cited

U.S. PATENT DOCUMENTS

| | | | | |
|---|---|---|---|---|
| 4,062,056 | A | 12/1977 | Goodrich | |
| 4,148,092 | A | 4/1979 | Martin | |
| 4,901,545 | A * | 2/1990 | Bacon et al. | 70/278.3 |
| 5,021,776 | A | 6/1991 | Anderson et al. | |
| 5,083,122 | A | 1/1992 | Clark | |
| 5,113,675 | A | 5/1992 | Uyeda | |
| 5,339,662 | A * | 8/1994 | Goldman | 70/277 |
| 5,475,996 | A | 12/1995 | Chen | |
| 5,541,581 | A * | 7/1996 | Trent | 340/5.55 |
| 5,609,051 | A | 3/1997 | Donaldson | |
| 5,617,082 | A | 4/1997 | Denison et al. | |
| 5,839,305 | A * | 11/1998 | Aston | 70/283.1 |
| 5,841,361 | A | 11/1998 | Hoffman | |
| 5,894,277 | A | 4/1999 | Keskin et al. | |
| 5,923,264 | A * | 7/1999 | Lavelle et al. | 340/5.64 |
| 6,000,609 | A * | 12/1999 | Gokcebay et al. | 235/382 |
| 6,079,238 | A * | 6/2000 | Hoffmann et al. | 70/283 |
| 6,097,306 | A | 8/2000 | Leon et al. | |
| 6,318,137 | B1 * | 11/2001 | Chaum | 70/278.3 |
| 6,337,618 | B1 * | 1/2002 | Craig et al. | 340/5.22 |
| 6,580,355 | B1 * | 6/2003 | Milo | 340/5.7 |
| 6,718,806 | B2 * | 4/2004 | Davis | 70/278.3 |

* cited by examiner

*Primary Examiner*—Davetta W. Goins

(57) ABSTRACT

An electronic lock module consisting of a series of electronic buttons used for entering a lock combination; LEDs for monitoring the status; a piezo-buzzer to provide audio feedback; a microcontroller circuit to process the input; a locking mechanism in the form of a combination cam and latching solenoid to actuate the mechanical interface which actually unlocks the lock; other components such as battery power and miscellaneous hardware round up the main parts. By pressing the buttons in a certain sequence, a code is sent to the microcontroller circuit which interprets it as valid or not in order to trigger or not the unlocking process. The mechanical interface is designed to be compatible with the ILCO mechanical locks so as to replace their current mechanical locking means. Of course, this present invention can be combined with newly created mechanical components so that this present invention can be used both as a retrofit or as a complete standalone lock.

14 Claims, 7 Drawing Sheets

ELECTRONIC LOCK MODULE

Figure 1:
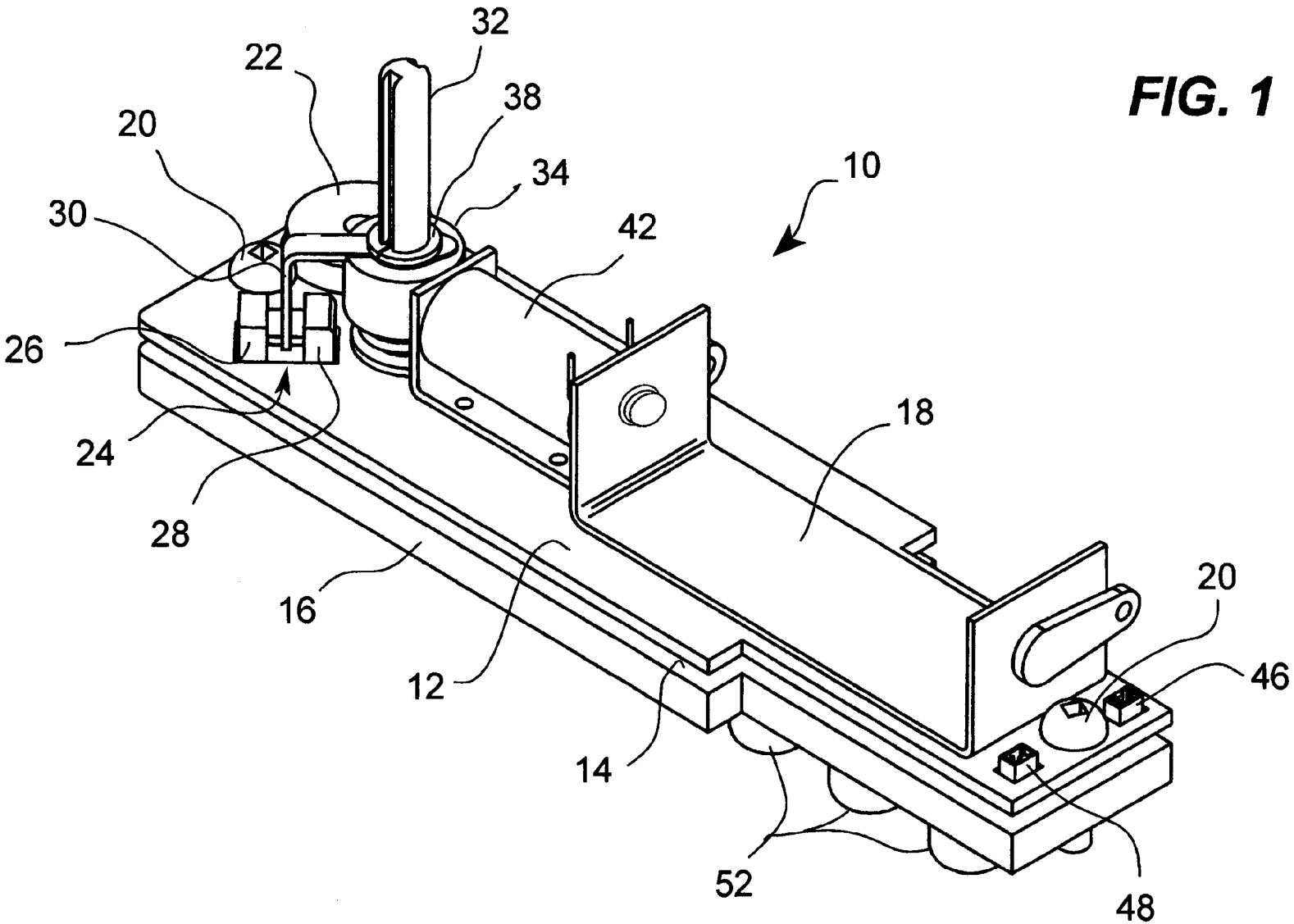

This application claims benefit of application Ser. No. 60/474,311 filed May 30, 2003.

BACKGROUND OF THE INVENTION

1. Field of the Invention

This invention relates generally to locking mechanisms but more particularly to a retrofit kit that can convert a mechanical lock into an electromechnical lock actuated through an electronic keypad.

2. Background

Mechanical locks have been around for a long time and in recent decades electronic locks have begun to replace rather primitive mechanical locks and offer several advantages over mechanical locks such as better access control by providing multiple access codes as well as dedicated time zones. Consequently electronic locks have already started to replace those mechanical locks but they are still quite expensive. For instance, an enterprise that wishes to replace its mechanical locks to offer better security is expected to spend thousands of dollars in new hardware, locksmith's fees and so on. To make matters worst, these new electronic lock casings are incompatible with the old mechanical lock's mounting holes arrangement so that new holes must be drilled into the door which increases replacement time, difficulties and frustrations. Furthermore, different case outlines and sizes sometime also require to repaint doors so as to mask the previous lock footprint.

There is therefore a need for a more practical way of replacing mechanical locks with electronic locks.

SUMMARY OF THE INVENTION

Take the all time most popular mechanical lock, (ILCO-Unican 1000-1 series), remove its mechanical combination chamber and replace it with a standalone electronic module which can interface with the remaining mechanical components to obtain a retrofit electronic lock from a mechanical lock. Also mechanical equivalents to the Ilco lock can be interfaced with the electronic lock module to create a new and complete electronic lock.

It is a first object of this invention to provide for an electronic lock module which can quickly retrofit an old mechanical lock by opening the lock's case, removing the combination chamber's screws and inserting the new electronic lock module.

It is a second object of this invention to provide for an electronic lock module which can transform a mechanical lock into a full featured electronic lock having multiple access codes and time zones as well as other features currently found in existing electronic locks.

It is a third object of this invention to provide for an electronic lock module which still makes use of the same mechanical lock's reliably proven clutch technology.

It is a fourth object of this invention to provide for an electronic lock module which still makes use of the same mechanical lock's rugged casing thus recycling it which is ecologically sound.

It is a fifth object of this invention to provide for an electronic lock module which does not need to drill new holes or repaint doors.

It is a sixth object of this invention to provide for an electronic lock module which provides the same look and feel of the old lock and still support simultaneous key pressing which gives the ability to have more than 2.5 billions access codes.

It is a seventh object of this invention to provide for an electronic lock module which has a unit cost far lower than that of an equivalent standalone electronic lock.

In order to do so, the present invention consists of a module having a series of electronic buttons used for entering a lock combination, LEDs for monitoring the status, a piezo-buzzer, a microcontroller circuit to process the input, a locking mechanism in the form of a combination cam and latching solenoid to actuate the mechanical interface which actually unlocks the lock, other components such as battery power and miscellaneous hardware round up the main parts. By pressing the buttons in a certain sequence, a code is sent to the microcontroller circuit which interprets it as valid or not in order to trigger or not the unlocking process. The mechanical interface is designed to be compatible with the ILCO mechanical locks so as to replace their current mechanical locking means. Of course, this present invention can be combined with newly created mechanical components interfacing with the electronic components since the original Ilco mechanism is well over twenty years old. This way, this present invention can be used both as a retrofit or as a complete standalone lock.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, providing additional features and advantages and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Orthogonal view of the lock module.

Figures 2, 3, 4:
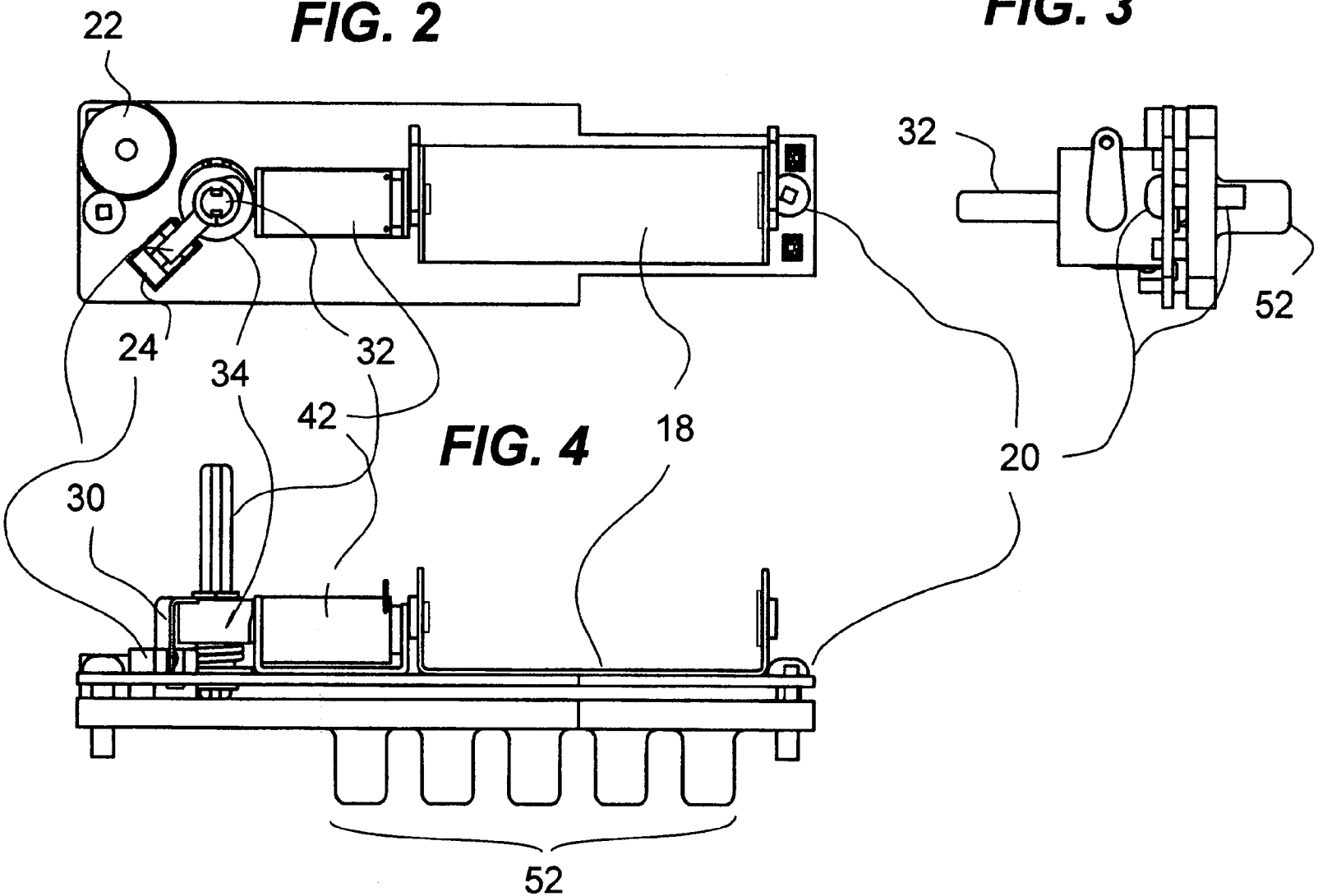

FIG. 2 Rear view of the lock module.

FIG. 3 Top view of the lock module.

FIG. 4 Side view of the lock module.

Figure 5:
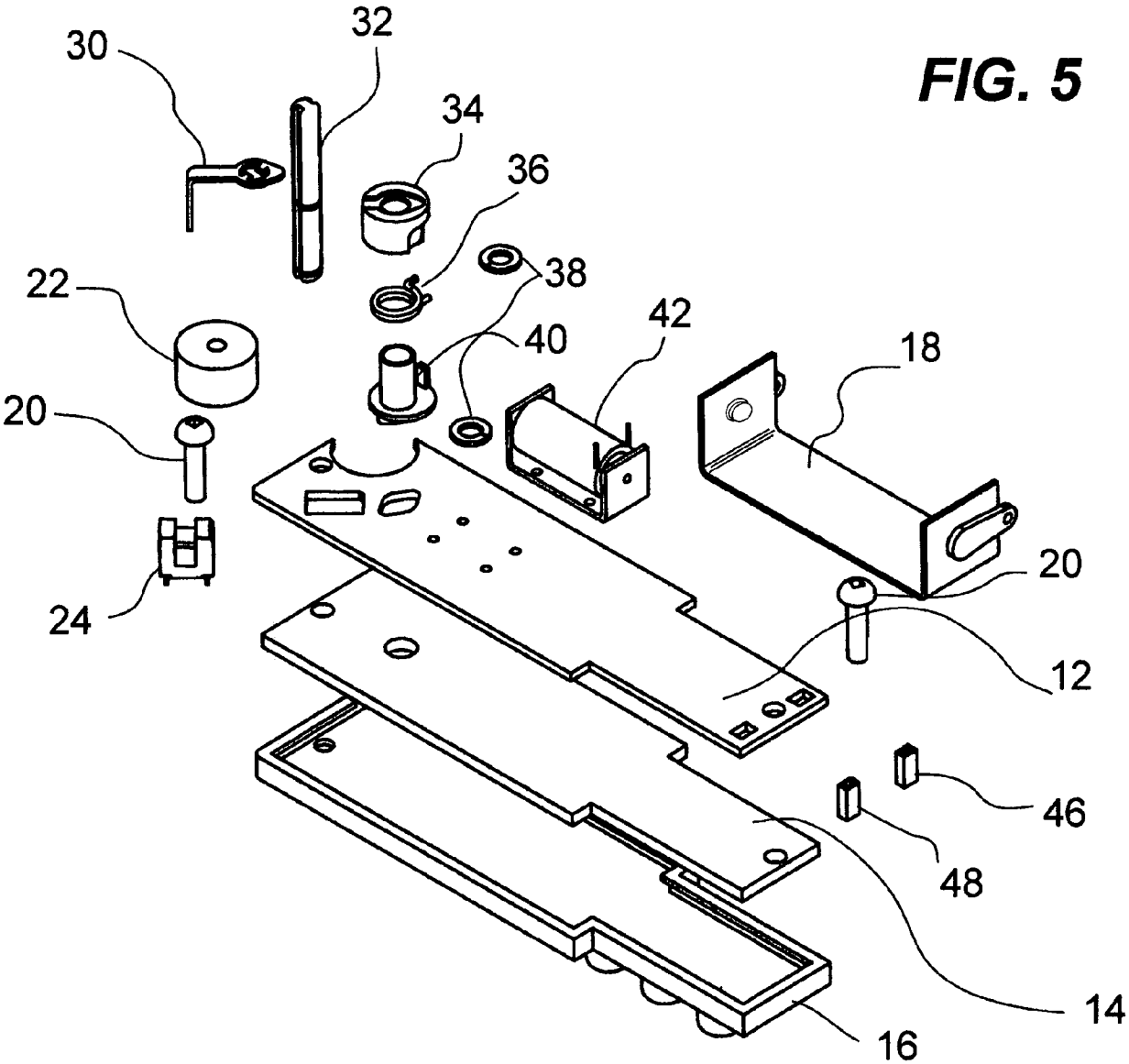

FIG. 5 Exploded orthogonal view of the lock module.

Figure 6:
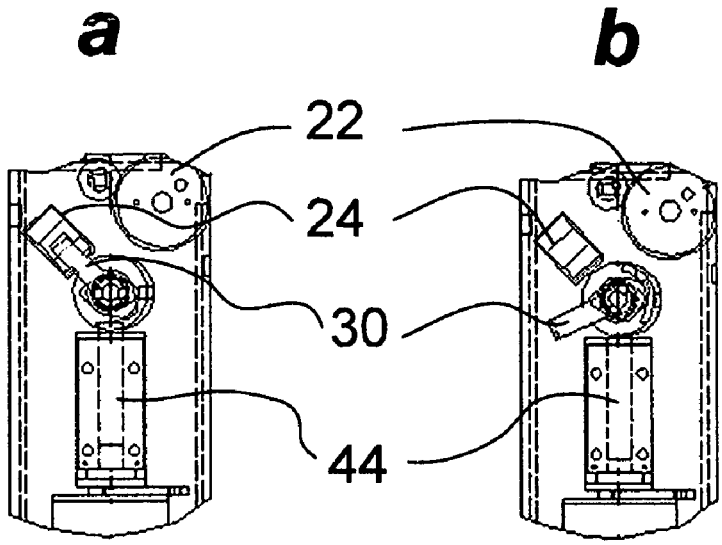

FIG. 6*ab* rear view of the lock module with the switch actuator blocking the light path and unblocking the light path respectively.

Figure 7:
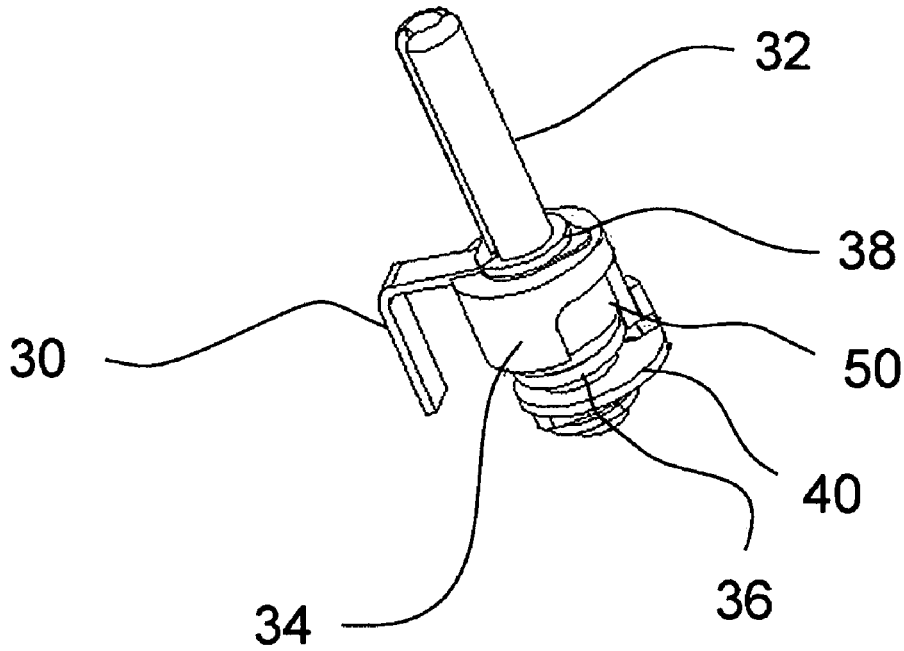

FIG. 7 Orthogonal view of the cam assembly.

Figure 8:
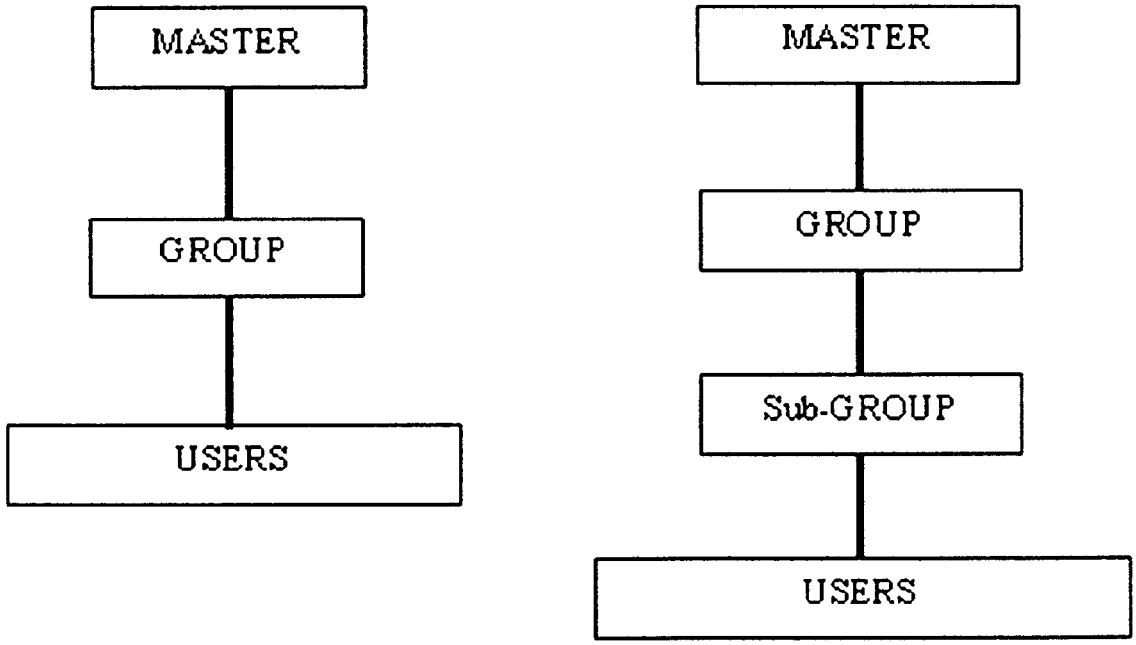

FIG. 8 master, group or subgroup, user hierarchy.

Figure 9:
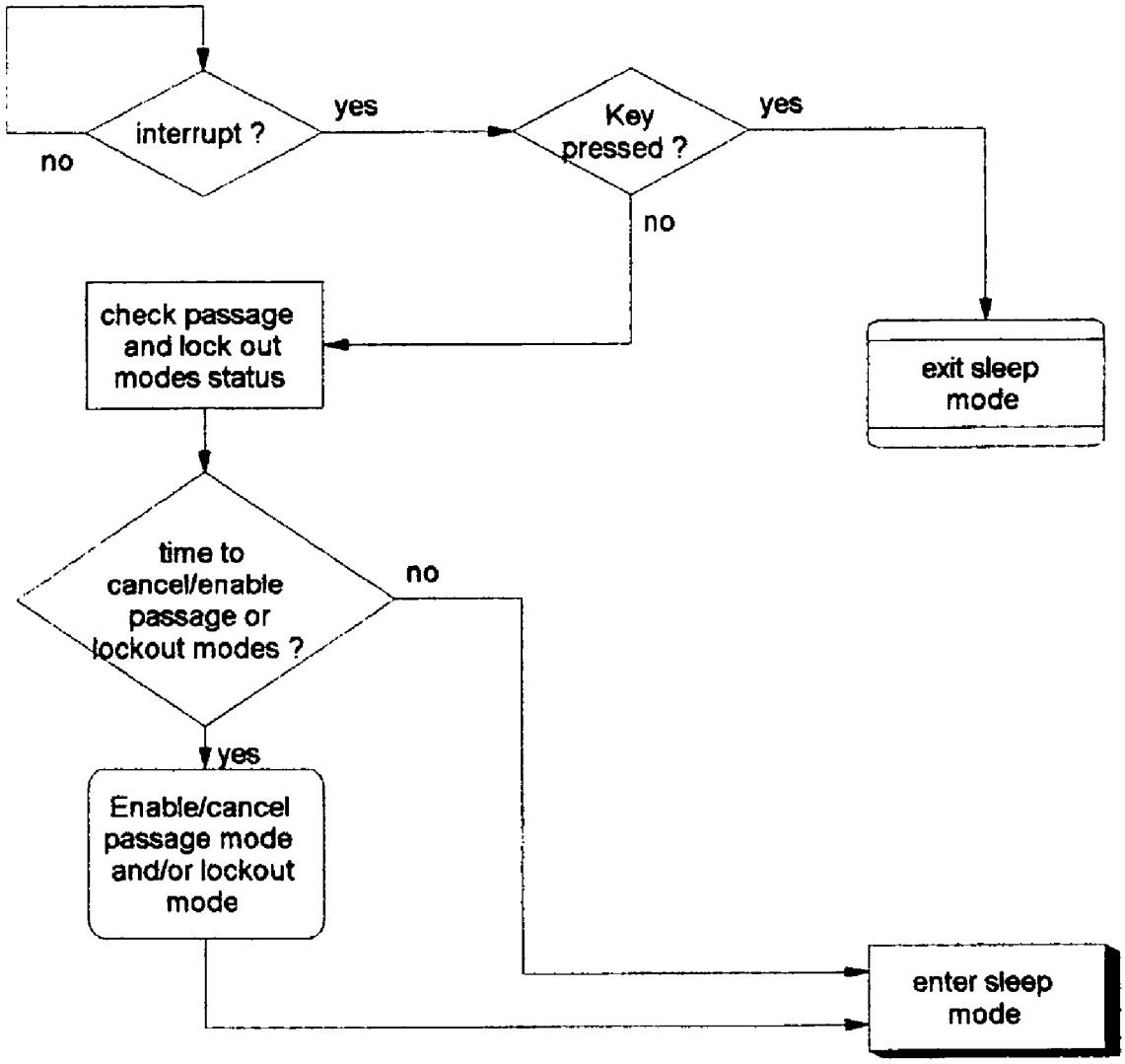

FIG. 9 Flow chart of the main loop.

Figure 10:
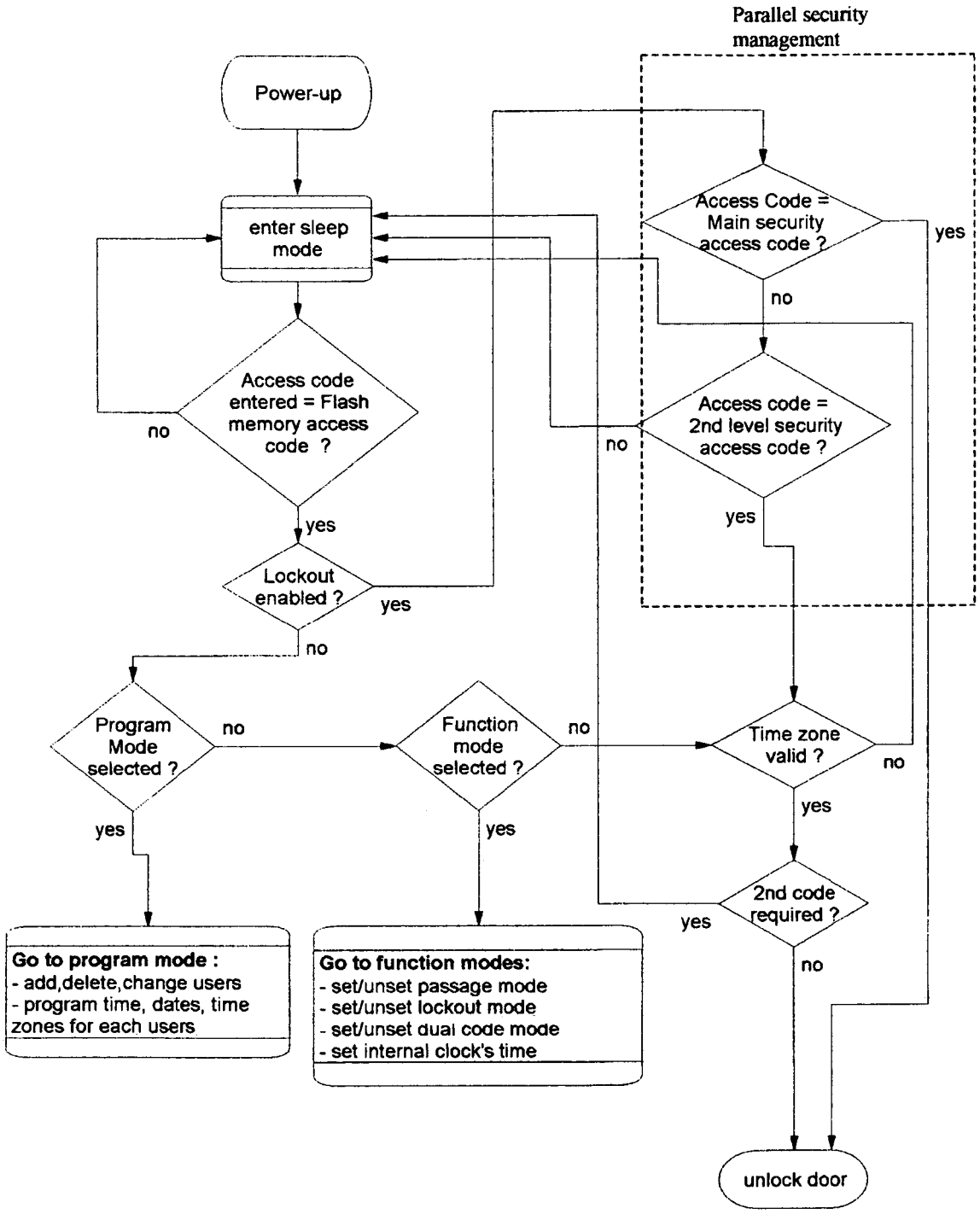

FIG. 10 Flowchart of the program logic.

PARTS LIST

Base plate 12
Printed Circuit Board PCB 14
Membrane 16
Battery holder 18 (batteries not shown)
Mechanical fasteners 20
Sound generator 22
Switch 24
Light source 26
Light captor 28
Switch actuator 30
Main rod 32

Cam 34
Return biasing means 36
Snap rings 38
Bushing 40
Latching solenoid 42
Plunger 44
Manual unlock connector 46
PC link connector 48
Cavity 50
Buttons 52

DETAILED DESCRIPTION OF THE PREFERRED EMBODIMENT

An electronic lock module (10) has a base plate (12) and a Printed Circuit Board (PCB) (14) which holds a microprocessor and associated logics (not shown). The base plate (12) has various components installed on it which are described henceforth:

A battery holder (18) which can receive one or more batteries depending upon the size and shape used or the autonomy desired. Mechanical fasteners (20) attach the electronic lock module (10) to the Ilco lock casing (not shown) in the case of a retrofit or any suitable casing in the case of a completely new lockable door knob assembly. In the case of an Ilco lock casing, the mechanical fasteners are screws but for other types of casings any suitable means to secure the electronic lock module (10) can be used which includes any types of retainers, bonding agents or mechanical fasteners either alone or in combination.

A latching solenoid (42) locks or unlocks a cam (34) which provides, by way of a main rod (32) the interface between the electronic lock module (10) and the rest of the existing mechanical lock components whether they be Ilco components or similar components. The details of the workings of the latching solenoid (42) and the cam (34) will be described later.

A sound generator (22) provides audio cue to a user and, in the current state of technology for the purpose at hand, can be embodied in the form of a piezo buzzer, of course, over time different technologies can be used for the same purpose.

A switch (24) to signal the microprocessor that it is time to activate the locking means which is embodied in the form of a plunger (44) pushed-out from the latching solenoid (42) and into a cavity (50) made into the cam (34). This switch (24) is preferably optical in nature because, unlike most existing locks which uses mechanical micro-switches, an optical switch has a much higher life span (MTBF) and performs well in sub-zero temperatures (−40 deg C.). Of course better more suitable types of switches can be used, all without departing from the scope of this invention.

The plunger (44) is held in the "unlock" position while the lock is in the unlock mode by way of the latching solenoid (42). As is known in the art, latching solenoids were created to have two rest positions which do not require current input, only a small current impulse, usually measured in milliseconds, is necessary to move the plunger (44) from one position to the other. The way it is done is by way of a permanent magnet (not shown) situated inside the latching solenoid (42) which holds the plunger (44) retracted inside the latching solenoid (42), a current impulse protracts the plunger (44) so that the permanent magnet no longer has a hold onto the plunger (44) or at least, with the combination of a biasing means (not shown), holds the plunger (44) into its new rest position until an impulse of reverse current pulls the plunger (44) back into the latching solenoid (42) to reassume its original rest position. Since there is no power consumption when the plunger (44) is in either rest positions, the lock module (10) can be left in an "unlock" or a "lock" mode for infinite amounts of time. The biasing means also makes sure that, by constantly pushing on the plunger (44) while in the "lock" mode, that accidental or purposeful "shocking out" of position of the plunger (44) by pounding on the lock case with a hammer or similar impact means is not possible.

In the "unlock" mode, the plunger (44), being retracted, cannot interfere with the cavity (50), therefore the plunger (44) cannot stop the cam (34) from rotating. In the "lock" mode, the plunger (44) is protracted and within the cavity (50) to engage it to stop the cam (34) from rotating. A return biasing means (36) returns the cam (34), not the door knob, to a rest position after a user has released the door knob to open the door. The main rod (32) is the only link between the electronic lock module (10) and the rest of the standard components such as the Ilco mechanism or other such mechanical equivalent. When a user turns the door knob, the turning force is transferred from the Ilco clutch arm up to the main rod (32) which in turn rotates the cam (34). Snap rings (38) keep the main rod (32) from moving along its longitudinal axis. A bushing (40) holds the cam (34) in place and allows the main rod (32) to be precisely stabled and centered on its axis.

A switch actuator (30) is used in conjunction with the switch (24) when the switch (24) is an optical switch the switch actuator (30) acts as a means for stopping a light beam between a light source (26) and a light captor (28). If a different type of switch is used, a structure similar to the switch actuator (30) can be used as a means for actuating a push switch for example. The light source (26) can be in the form of an LED and the light captor (28) can be in the form of a photocell as per the current state of technology but any other device can be used without departing from the scope of this invention. It is important as a feedback feature to have the switch (24) because when a user enters a code to unlock the lock module (10), the latching solenoid (42) will retract the plunger (44) so that it allows the cam (34) to freely rotate. Normally, the switch actuator (30) blocks the path of light as per FIG. 6*a* but once the door knob has been rotated, the switch actuator (30) unblocks the path of light, as per FIG. 6*b*, once the door knob has been released and the switch actuator (30) again blocks the path of light, this sequence sends a signal to the latching solenoid (42) to protract the plunger (44) because at that point, the cam (34) has rotated and presents its cavity (50) to the plunger (44) which will then penetrate it.

In front of the base plate (12) is a membrane which has protruding buttons (52) which are exposed and accessible to a user. The buttons (52) are designed so as to be luminous in order to provide visual cues to a user such as when programming. For example, when entering a time such as 14:52 the first button would flash once, the second four times, the third five times and the fourth twice. The fifth button is a button that can be used for warnings such as low power or other warnings. The membrane (16) also serves to protect the PCB (14) and its component from being in direct contact with humidity, dust or other contaminants.

A manual unlock connector (46) is used to attach an external switch for remote unlock and a PC link connector (48) is used to exchange data between the electronic lock module (10) and a remote computer. This way, audit trail information as well as remote programming can be performed.

The flowcharts of FIGS. 7–9 show the programming steps of the Master, Group, Sub-Group or User access codes. It also shows the parallel security access management used to override lockout modes.

The main features which are believed to be unique to this invention are:

1) Possibilities to set dual code access modes. In this mode, two access codes need to be entered within a short period of time in order to unlock the lock module (10). This is useful to increase the level of security when gaining access to highly restricted areas. One code by itself can't unlock the lock module (10), meaning two users must be present each with its own access code in order to unlock the lock module(10).

2) Low battery status by means of mechanical feedback. Besides using a conventional audible signal, the lock module (10) will increase the "unlock" delay in order to indicate a low battery condition. In a valid charge condition, lock module (10) is set to unlock almost instantly after the access code has been validated. Once battery voltage falls below a preset level, the unlock time will increase by a few seconds. The more the battery falls dead, the longest delay will be felt by the user, The advantage of this feature serves as a counter measure against normal human behavior to wait until the battery is dead before replacing it. This way, it is expected that the extra delay becomes annoying enough to force the user to provide for battery replacement.

3) Simultaneous key depressing. With only 5 digits (1 to 5) at least two of them can be combined together to achieve over 2.5 billions access codes (1 to 5, 1+5, 1+4, 1+3 etc . . . –>15^8) when using an 8 digits access code.

4) Also, not found in any current electronic lock is the ability to have a parallel access management system dedicated for security or maintenance personnel. This second parallel system gives security personnel the ability to override any programmed lockout modes in case of an emergency or other access purposes. The security manager also has the ability to create other security codes of its own which are completely separate from the ones that the master, group or subgroup managers may have created.

The invention claimed is:

1. An electronic lock module comprising:

a printed circuit board (PCB) to hold a microprocessor and associated logics, a base plate to hold a battery holder a latching solenoid to lock and unlock a cam;

a main rod to provide an interface between said electronic lock module and the rest of the existing mechanical lock components whether they be Ilco components or mechanical equivalents;

a sound generator to provide audio cue to a user;

a switch to control lock and unlock modes;

a switch actuator to actuate said switch;

a latching solenoid to actuate a plunger;

a cam having a cavity;

said plunger interfacing with said cavity by engaging said cavity to enter lock mode;

said plunger interfacing with said cavity by disengaging said cavity to enter unlock mode;

a return biasing means to return said cam to its rest position;

a membrane having buttons to provide interface with a user;

securing means to secure said electronic module to existing mechanical lock components whether they be Ilco components or mechanical equivalents.

2. An electronic lock module as in claim 1 wherein:

snap rings keep said main rod from moving along its longitudinal axis;

a bushing holds said cam in place and allows said main rod to be precisely stabled and centered on its axis.

3. An electronic lock module as in claim 1 wherein:

said switch is an optical switch and said switch actuator blocks the path of light of said optical switch.

4. An electronic lock module as in claim 1 wherein:

a manual unlock connector attaches an external switch for remote unlock.

5. An electronic lock module as in claim 1 wherein:

a PC link connector exchanges data between said electronic lock module and a remote computer.

6. An electronic lock module as in claim 1 wherein:

said securing means of said electronic lock module selected from the group comprising but not limited to retainers, bonding agents or mechanical fasteners either alone or in combination.

7. An electronic lock module as in claim 6 wherein:

screws are used as said securing means when using an Ilco lock casing.

8. An electronic lock module as in claim 1 wherein:

said sound generator being a piezo buzzer.

9. An electronic lock module as in claim 1 wherein:

said switch preferably an optical switch with said switch actuator blocking the path of light.

10. An electronic lock module as in claim 1 wherein:

said membrane having luminous buttons.

11. An electronic lock module as in claim 1 wherein:

it is possible to set dual code access modes.

12. An electronic lock module as in claim 1 wherein:

low battery status being indicated by means of mechanical feedback.

13. An electronic lock module as in claim 1 wherein:

simultaneous key depressing achieves billions of access codes.

14. An electronic lock module as in claim 1 wherein:

parallel access management system features are offered.

* * * * *